US005422666A

United States Patent [19]

Koyama

[11] Patent Number: 5,422,666

[45] Date of Patent: Jun. 6, 1995

[54] RECORDING METHOD IN INKJET RECORDING APPARATUS

[75] Inventor: Toshio Koyama, Ebina, Japan

[73] Assignee: Fuji Xerox Co., Ltd., Tokyo, Japan

[21] Appl. No.: 128,136

[22] Filed: Sep. 29, 1993

[30] Foreign Application Priority Data

Oct. 8, 1992 [JP] Japan ..... 4-296470

[51] Int. Cl.[6] ..... B41J 2/01

[52] U.S. Cl. ..... 347/41

[58] Field of Search ..... 347/40, 41, 43

[56] References Cited

U.S. PATENT DOCUMENTS 4,965,593 10/1990 Hickman ..... 347/41
4,967,203 10/1990 Doan et al. ..... 347/41
5,111,302 5/1992 Chan et al. ..... 347/43

FOREIGN PATENT DOCUMENTS 63-312155 12/1988 Japan .
64-67348 3/1989 Japan .
2-4523 1/1990 Japan .

*Primary Examiner*—Benjamin R. Fuller
*Assistant Examiner*—N. Le
*Attorney, Agent, or Firm*—Oliff & Berridge

[57] ABSTRACT

In a recording method for using an inkjet recording apparatus, multi-color image recording is performed by reducing a beading phenomenon generated between adjacent dots and preventing nonuniformity in density and bleeding. When the printing is performed on a non-absorptive translucent recording medium such as the OHP film, dots in one line are divided, for example, in blocks each having four dots of 2×2 dots, and each dot in the block is printed by one scanning operation. The printing is performed in an order so that successive printing of dots adjacent to each other in the top, bottom, right and left directions is minimized. For example, the dots may be printed in the order of the left top, right bottom, right top, and left bottom. Thus, the printing for one line is performed by four scanning operations.

5 Claims, 4 Drawing Sheets

RECORDING METHOD IN INKJET RECORDING APPARATUS

BACKGROUND OF THE INVENTION

1. Field of the Invention

The present invention relates to a recording method in an inkjet recording apparatus, and more particularly to a recording method of forming a picture image on a recording medium having a relatively low absorption ability of ink such as an original picture of an overhead projector (OHP).

2. Description of the Related Art

As is well known, in an inkjet recording apparatus, the recording quality is greatly affected by the physical properties of a recording medium. In general, a specialized paper such as an inkjet printer single-purpose paper is recommended for each recording apparatus. The specialized paper is specified in its physical properties such as the diffusion rate, absorption rate and reflection density of the printed ink droplet. At present, the inkjet recording apparatus is designed so that the desired printing quality can be obtained with use of such a specialized paper.

When the recording is performed, using such an inkjet recording apparatus, on a recording paper other than the specialized paper, particularly, a translucent recording medium (hereinafter, referred to as OHP film) used for an overhead projector and the like which has a relatively low absorption ability of ink, a dot diameter is made smaller as compared with that for the specialized paper depending on the difference between the physical properties of the recording mediums.

FIG. 4 is a view showing printed dots on a recording medium. In the normal printing state by use of the specialized paper or the like, as shown in FIG. 4A, the printing is performed with a dot diameter larger than a dot interval D calculated on the basis of 1/resolution; and in the ideal state, with a dot diameter d expressed by the following equation: .

$$d = (\text{dot interval } D) \times \sqrt{2}$$

With such a dot diameter, even when the printing is performed over the whole surface, the portions where the under color of the recording medium appear are made smaller, thus making it possible to obtain an excellent printing quality. However, for the recording on the OHP film or the like, as shown in FIG. 4B, a dot diameter d' is smaller than the dot interval D, and a large gap is generated between a dot and the surrounding dots. When the printing is performed over the whole surface in such a state, there occur a lot of non-printed portions due to the gaps. This causes such a disadvantage that the printing density is lowered and thus the printing quality is significantly degraded. In addition, due to the contraction of the dot, the ink is not easily absorbed and dried, that is, not easily fixed to the surface of the OHP film or the like.

To be printed with a dot diameter d larger than the dot interval D as shown in FIG. 4A, the OHP film has been improved in the diffusion and fixing performances of the ink droplet by applying a surface treatment thereon. However, the OHP film having the same characteristics as the specialized paper is not obtained by improvement of the diffusion and fixing performances, and is disadvantageous as yet in differing from the specialized paper in the absorption rate of ink. Namely, in contrast to the specialized paper, the OHP film has a small absorption rate of ink. Consequently, in the printing with a large dot diameter d, as shown in FIG. 4*c*, the adjacent ink droplets are contacted with each other, and the original shapes of the ink droplets are deformed. This is called a beading phenomenon.

FIGS. 5(A) and 5(B) are views showing the densities of ink droplets on a recording medium In this figure, a', b', c' indicate ink droplets, and a, b, c indicate intervals. FIG. 5A is for the printing performed on an ideal recording medium, wherein each ink droplet is slightly overlapped in the peripheral portion, being permeated in a recording medium, and is fixed with an uniform density. However, when a beading phenomenon is generated, for example, when the ink droplet a', is contacted and bonded with the ink droplet b , the dot shapes of the ink droplets are deformed. Thus, the area b being high in density is formed at the bonded portion in the area a of the bonded droplets, whereas the area c being low in density is formed around the bonded ink droplets. Namely, due to the generation of the beading phenomenon, the printing density is not made uniform just as in FIG. 5A, resulting in the nonuniformity in density. As for the nonuniformity in density, when color printing is performed, there occurs a beading phenomenon between different colors. This brings about a disadvantage in causing the bleeding between the picture elements. In addition, the OHP film is placed on an overhead projector, and is largely projected by transmission of a light. In the enlarged projection of the OHP film, the nonuniformity in density and the bleeding are also enlarged, which causes a disadvantage in significantly degrading the quality of the projected image.

Conventionally, various methods have been developed for performing the printing on a recording paper having a relatively low absorption ability of ink such as the OHP film. For example, in a technique disclosed in Unexamined Japanese Patent Publication No. HEI 2-4523, the printing for one line is repeated for each color by the number of colors, to prevent the generation of bleeding. However, for one color, this technique performs the printing of adjacent dots. In other words, the beading phenomenon as described above is not under consideration. Accordingly, for a recording apparatus in which the dot diameter is smaller than the dot interval, or excellent picture can be formed; however, for the recording apparatus in which the dot diameter is larger than the dot interval, it is impossible to prevent the nonuniformity in density due to the beading phenomenon in which the adjacent ink droplets are contacted with each other and the original shapes of the ink droplets are deformed. As a result, there remains the generation of the bleeding due to the color deviation caused by the nonuniformity in density for each color, which cannot be prevented by this process.

Unexamined Japanese Patent Publication No. SHO 63-312155 has disclosed a such technique that gaps between dots are buried by alternately performing two scanning operations, and a time difference is set between the first and second scanning operations, to prevent the bonding of ink droplets. Further, a technique for preventing a beading phenomenon has been disclosed in Unexamined Japanese Patent Publication No. SHO 64-67348, wherein the printing is performed twice with a checker board pattern. In these techniques, particularly, in the latter technique, dots adjacent to each other in the diagonal direction are printed by the first scanning operation; and dots adjacent to each other in the top and bottom and in the right and left directions, which tends to cause a beading phenomenon, are printed by a different scanning operation, to avoid the beading phenomenon. However, in the recording medium such as the OHP film, until the second scanning operation is performed, the fixing of dots formed in the first scanning operation is not completed. As a result, a beading phenomenon is generated between the dots formed in the second and the first scanning operations, to cause the nonuniformity in density and the bleeding, thus degrading the printing quality.

SUMMARY OF THE INVENTION

Accordingly, an object of the present invention is to provide a recording method in an inkjet recording apparatus capable of performing excellent multi-color image printing on a recording medium having a relatively low absorption ability of ink such as an OHP film by suppressing the nonuniformity in density and the bleeding caused by a beading phenomenon.

In a preferred embodiment of the present invention, there is provided a recording method in an inkjet recording apparatus of performing printing by discharging ink droplets on a recording medium in response to recording information, comprising the steps of: dividing dots to be recorded into blocks, each having at least four dots; and repeating the scanning and printing by at least four times according to the number of the dots in each block.

According to the present invention, by dividing dots to be recorded into blocks, each having at least four dots, and repeating the scanning and printing by at least four times according to the number of the dots in each block, the printing can be performed such that dots printed by each scanning is not adjacent to dots printed by the last scanning in the top, bottom, right and left directions. Accordingly, even when the recording is performed on a recording medium having a relatively low absorption ability of ink such as an OHP film, it is possible to reduce the beading phenomenon generated between ink dots and to prevent the nonuniformity in density and the bleeding, and hence to obtain a high quality picture image.

DETAILED DESCRIPTION OF THE PREFERRED EMBODIMENTS

Hereinafter, embodiments of the present invention will be described in detail with reference to the accompanying drawings.

Figure 1:
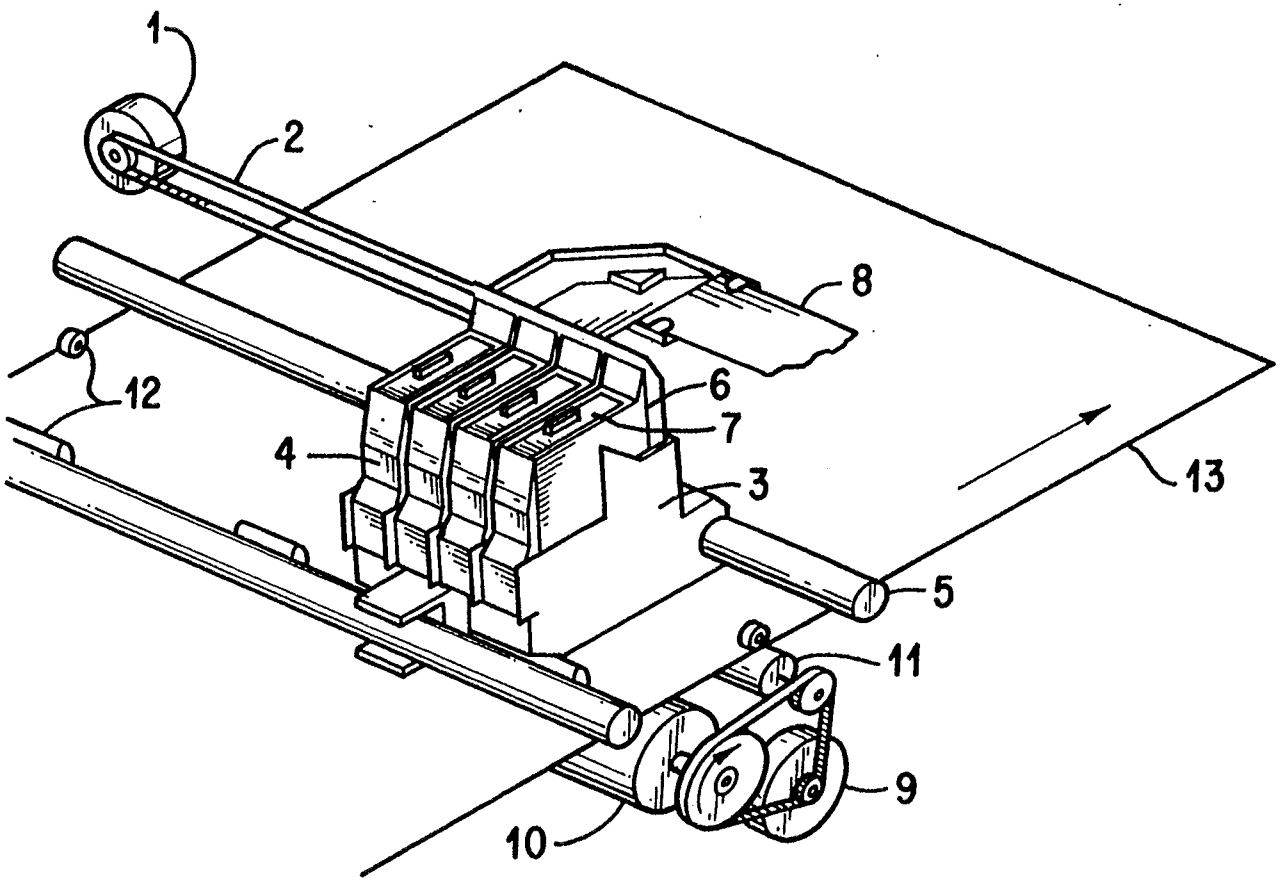
FIG. 1 is a schematic construction view showing one embodiment of an inkjet recording apparatus by means of which the recording method of the present invention is practiced.

FIG. 1 is a schematic construction view showing one embodiment of an inkjet recording apparatus by means of which the present invention is practiced. In this figure, reference numeral 1 is a drive motor; 2 is a timing belt; 3 is a head carriage; 4 is a lock lever; 5 is a guide; 6 is a recording head; 7 is an ink tank; 8 is a feed signal cable; 9 is a paper feeding motor; 10 is a feed roll; 11 is an exit roll; 12 is a pinch roll; and 13 is a recording paper.

The drive motor 1 moves the head carriage 3 through the timing belt 2, to feed power for scanning. The timing belt 2 connects the drive motor 1 to the head carriage 3, to transmit the power of the drive motor 1 to the carriage 3 for moving the head carriage 3 along the guide 5, thus performing the scanning. A plurality of recording heads 6 are mounted on the head carriage 3, and are fixed thereto by lock levers 4. The lock levers 4 are intended to position and fix the recording head 6 mounted on the head carriage 3. In movement of the head carriage 3, the guide 5 restricts the movement direction of the head carriage 3. The recording head 6 discharges ink droplets and performs the recording on the recording paper 13. The ink discharged from the recording head adheres on the recording paper 13, to thus perform the recording. The ink discharged from the recording head 6 is fed by the recording tank 7 mounted on the recording head 6. The recording head 6 is connected to the feed signal cable 8 for transmitting a head drive signal for performing a discharging operation of ink droplets according to the head drive signal. Further, a plurality of recording heads 6 are fixed on the head carriage 3, and are moved along the guide 5 integrally with the head carriage 3. A plurality of recording heads 6 mounted on the head carriage 3 are constructed to discharge different color inks. This enables color printing. The samples of the ink colors include cyanogen, magenta, yellow, and black. In using such color inks, preferably, the recording heads are so constructed that the printing dots are arranged in order of black, cyanogen, magenta, and yellow from the right as shown in FIG. 1. Other color inks maybe used, for example, the inks of red, green, and blue. The ink tank 7 is mounted on the recording head 6 for feeding the ink to be recorded to the recording head 6. The feed signal cable 8 feeds printing data, control signals and the like from a controller (not shown) to the recording head 6. The power of the paper feeding motor 9 is transmitted to the feed roll 10 and the exit roll 11, to clamp the recording paper 13 together with the pinch roll 12 for moving the recording paper 13 in the direction perpendicular to the movement direction of the head carriage 3.

The operation of the embodiment of the inkjet recording apparatus described above will be described. The inkjet recording apparatus has a normal printing mode for performing the printing on the specialized paper, and a printing mode for performing the printing on the recording medium having a relatively low absorption ability of ink in comparison to the specialized paper, such as the OHP film. Either of the above printing modes is selected by a switching means (not shown), and the printing operation is performed.

First, the operation for the normal printing mode will be described. The recording paper 13 is clamped between the feed roll 10 driven by the paper feed motor 9 and the pinch roll 12 , and is carried from the right forward side to the left backward side in FIG. 7. Further, it is clamped between the exit roll 11 driven by the paper feed motor 9 and the pinch roll 12, and is carried on the discharge side. Thus, the recording paper 13 is stopped at the position in which the printing is to be performed. The head carriage 3 mounting the recording heads 6 is driven by the drive motor 1, and is moved along the guide 5 from the left to the right. The recording heads 6, while being moved, discharge inks fed from the ink tanks 7 as ink droplets to the recording paper 13 on the basis of the printing data and the control signals and the like fed through the feed signal cable 8, to thus perform the recording for one line on the recording paper 13. In the recording for one line, during one scanning operation, respective inks are discharged from a plurality of recording heads 6 mounted on the head carriage 3. At this time, the recording is performed on the recording paper 13 with a dot diameter d larger than the dot interval D.

After completion of the recording for one line, the paper feed motor 9 is driven, and the recording paper 13 is fed by one line or a specified feed amount by the feed roll 10, the exit roll 11 and the pinch roll 12. In one directional printing, when the recording paper 13 is advanced, the head carriage 3 is returned to the left side in the figure again, and the recording for the next one line is started. In both directional printing, when the recording paper 13 is advanced, the recording head is stopped or is moved to be positioned at the right end of the printing area of the next line; and the recording for the next line is performed by moving the head carriage 3 from the right to the left in FIG. 7. By repeating the printing for one line in the manner as described above, the recording for the recording paper is completed. After that, the paper feed roll 9 is driven, and the recording paper 13 is discharged by the feed roll 10, exit roll 11 and pinch roll 12.

The operation for the printing mode in which the printing is performed on the recording paper having a relatively low absorption ability of ink such as the OHP film will be described. When the above mode is selected by the switching means (not shown), the dots to be recorded are divided into blocks each having at least four dots, and the recording for one line is performed by at least four printing operations. In this mode, as the recording paper 13, there is used a non-absorptive translucent recording medium having a characteristic near the absorptive recording medium such as the OHP film subjected to the surface treatment. The paper feeding, advancing and discharging operations of the recording medium, and one scanning operation of the head carriage 3 are the same as in the normal mode.

Figure 4A:
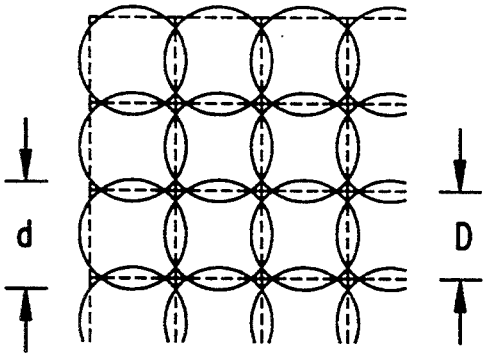
FIG.4A PRIOR ART
FIGS. 4A–4C are views for explaining printed dots on a recording medium.
Figure 4B:
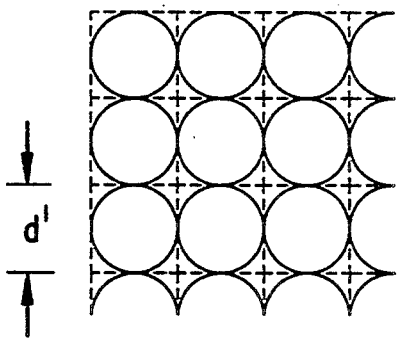
FIG.4B PRIOR ART
Figure 4C:
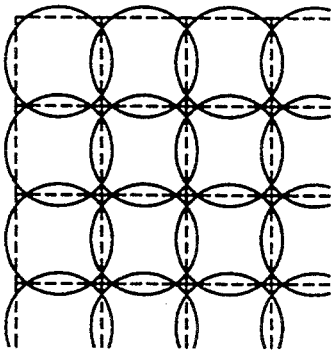
FIG.4C PRIOR ART
Figure 5A:
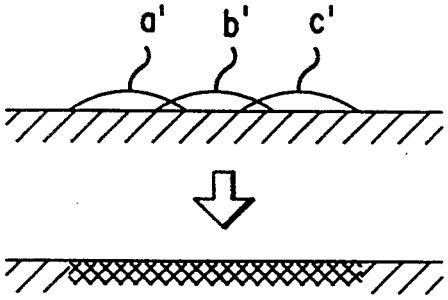
FIG.5A PRIOR ART
FIGS. 5A–5B are views for explaining the densities of ink droplets on a recording medium.
Figure 5B:
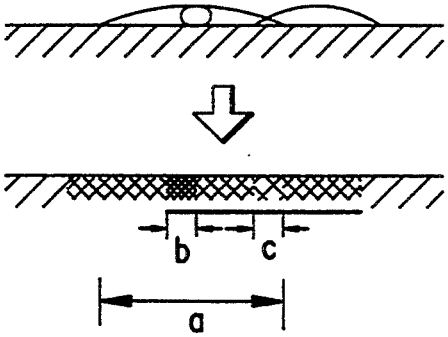
FIG.5B PRIOR ART

FIG. 2 is a view for showing an example of operations in the recording method of the present invention. In this figure, the upper column shows the dots printed in respective scanning operations, and the lower column shows the dots recorded on the recording medium. A circle mark shows a dot, and the symbol "MC" in the circle mark means the dot printed by two colors of magenta and cyanogen. In this example, dots are divided into blocks each having four dots (2×2 dots). Each dot in the block is printed by one scanning operation, and the printing for one line is performed by four scanning operations. At this time, the recording is performed on a recording medium such as an OHP film with a dot diameter d larger than the dot interval D as shown in FIG. 4A.

Figures 2A, 2B, 2C, 2D:
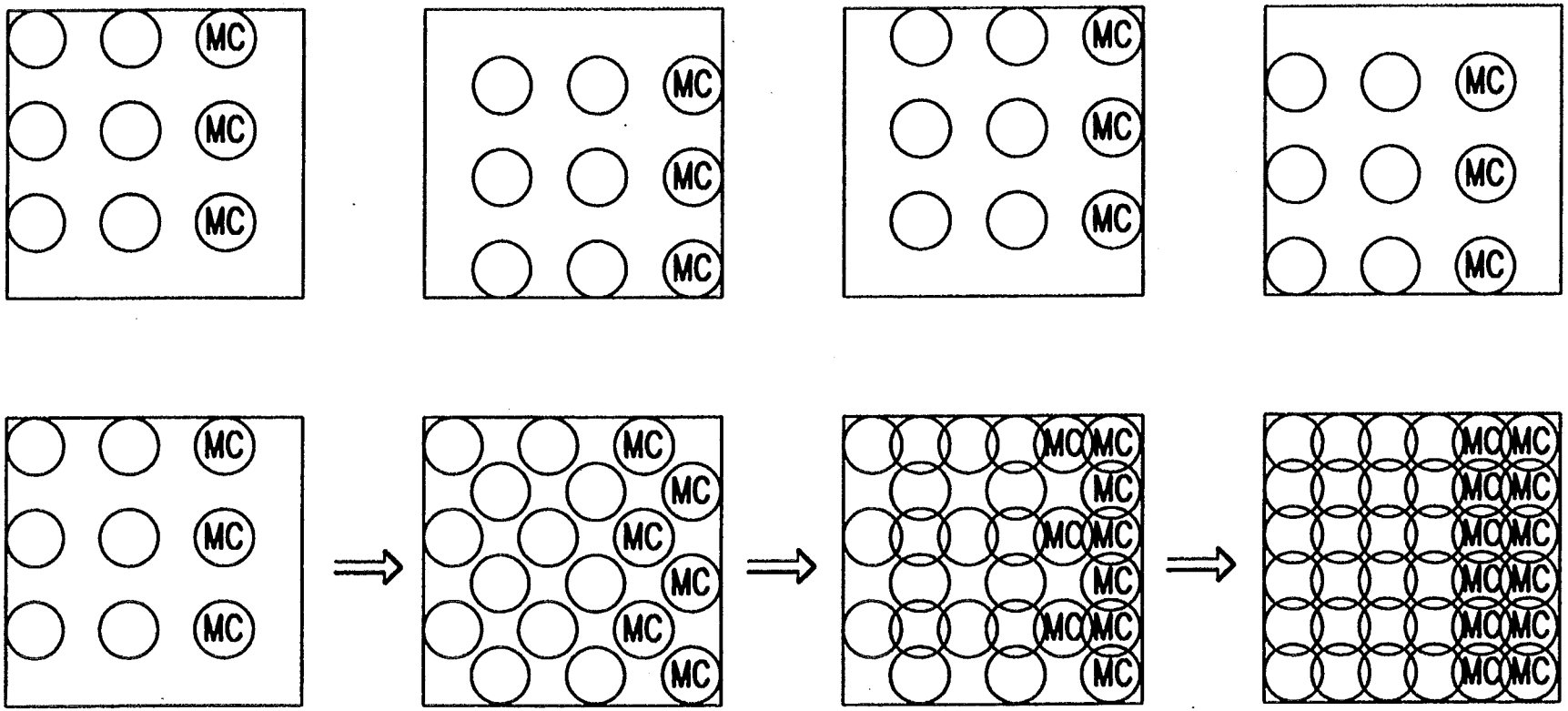
FIGS. 2A–2D are views for explaining an example of operation by the recording method of the present invention.

In the printing for a certain line, by the first scanning operation, for example, a dot at the left top of the dots in the block with four dots is printed. For each dot, different color inks from respective recording heads 6 are overlapped and printed. The dots printed by the first scanning operation are one-fourth the whole dots as shown in FIG. 2A. In this case, since any dot to be printed is not present around each dot, the beading phenomenon is never generated in printing. The first scanning operation is performed by movement of the head carriage 3 mounting the recording heads 6 along the guide 5 from the left to the right in FIG. 1. After completion of the first scanning operation, the second scanning operation is started without advancing the recording medium. At this time, the head carriage 3 may be returned to the left and moved from the left to the right again, or the reversed scanning from the right to the left may be performed.

By the second scanning operation, the dot at the right bottom in the block with 2×2 dots is printed. The dots printed by the second scanning operation are shown in the upper column in FIG. 2B. Just as in the first scanning operation, since any dot to be recorded is not present around each dot, the beading phenomenon is never generated. Further, the dots in the second scanning are not adjacent to the dots in the first scanning in the top and bottom directions and in the right and left directions. Accordingly, the beading phenomenon is never generated between the dots in the first and second scanning operations. The dots recorded on the recording paper by the first and second scanning operations are shown in the lower column of FIG. 2B.

Similarly, the dot at the right top in each block with 2×2 dots is printed by the third scanning operation. The dots thus printed are shown in the upper column of FIG. 2C, and the dots recorded on the recording paper by the first to third scanning operations are shown in the lower column of FIG. 2C. The dot at the left bottom in each block with 2×2 dots is printed by the fourth scanning operation. The dots thus printed are shown in the upper column of FIG. 2D, and the dots recorded on the recording paper by the first to fourth scanning operations are shown in the lower column of FIG. 2D. After the end of the fourth scanning operation, the recording for one line is completed, and the recording paper 13 is fed by one line or a specified feed amount.

In the method of performing the printing by four scanning operations with the divided blocks each having 2×2 dots as described above, the dots printed by the third operation are positioned upwardly of the dots printed by the second operation. These dots are vertically contacted with each other. Accordingly, there is a fear of causing a beading phenomenon between the dots printed in the second and third scanning operations. However, in the conventional manner in which 2×2 dots are printed by two scanning operations, there is a fear of causing the beading phenomenon for all dots. According to the recording method of the present invention, there is only a fear of causing a beading phenomenon between the dots printed by the second and third operations, so that it is possible to significantly suppress the beading phenomenon.

FIG. 3 is a view for explaining an example of division of dots into blocks and of printing orders. In this figure, the number in the circle mark shows the printing order. In the above description, the blocks of 2×2 dots are printed in the order of the left top, right bottom, right top, and left bottom. This example is shown in FIG. 3A. The printing may be of course performed in the other orders. For example, as shown in FIG. 3B, the printing may be performed in the order of the left top, right bottom, left bottom and right top. Further, the dots are first printed at the left bottom, right top or right bottom, and then the printing order of the other dots may be determined.

Figure 3A:
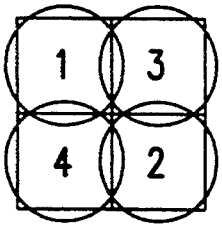
FIGS. 3A–3F are views for explaining an example of division of dots into blocks and the printing orders.
Figure 3B:
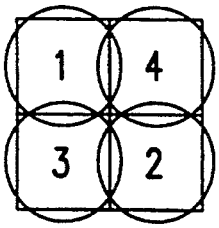
Figure 3C:
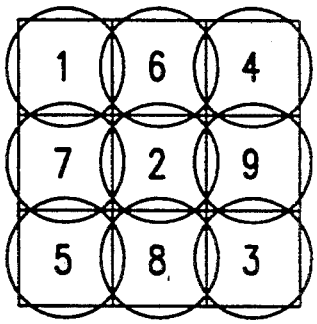
Figure 3D:
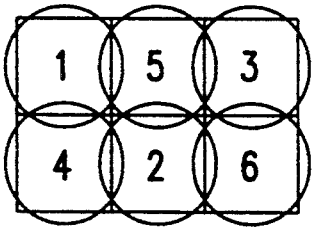
Figure 3E:
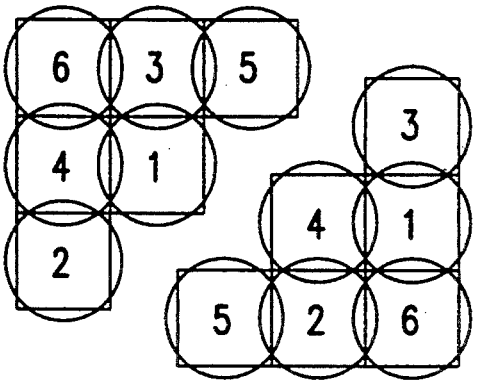
Figure 3F:
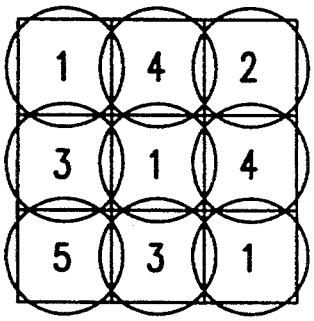

The division of dots is not limited to the block with 2×2 dots. For example, dots may be divided into various rectangular blocks: a block with 3×3 dots as shown in FIG. 3C; and a block with 2×3 or 3×2 dots as shown in FIG. 3D. Further, the block is not limited to the rectangular shape, and may be variously shaped, for example, in a block of 6 dots as shown in FIG. 3E. As shown in this example, in adjacent blocks, the printing order is not necessarily fixed. As for the printing order for dots in each block as shown in FIG. 3, various order may be considered. The printing order is, preferably, so constructed that dots are not successively printed in the top, bottom, right and left directions. However, just as in the 2×2 dots, if the generation of the beading phenomenon in a slight degree is allowable, the order of continuously printing dots in the top, bottom, right, and left may be used within the allowable range. In this case, the degree of freedom in the design for the shape of the block and for the printing order is increased. Further, in the case of a large block, it is possible to perform the printing of 2 dots or more during one scanning, and to complete the printing by the scanning operations in the number smaller than that of dots in the block. For example, as shown in FIG. 3F, the printing of blocks with 3×3 dots is completed by five scanning operations.

As is apparent from the above description, according to the present invention, even in the case when the printing is performed on a recording paper having a relatively low absorption ability of ink such as an OHP film, it is possible to reduce a beading phenomenon caused by the contact and bonding of the adjacent dots, and to prevent the nonuniformity in density and bleeding, and hence to obtain a high quality picture image.

What is claimed is:

1. A recording method in an inkjet recording apparatus for printing by discharging ink droplets on a recording medium in response to recording information with a recording head having a plurality of inkjet recording elements, said recording head being driven for scanning an elongated area in a first direction, said recording medium being advanced in a second direction transverse to said first direction, the method comprising the steps of:

dividing the elongated area to be recorded into blocks each having at least four dots arranged in two rows and two columns; and repeating a scanning operation for the elongated area by a number of times equal to the number of said dots in each of said blocks, a different one of said dots in each of said blocks being selected for printing upon each of the scanning operations.

2. A recording method according to claim 1, wherein said blocks are shaped to be rectangular.

3. A recording method according to claim 1, wherein said printing is performed in an order where diagonally adjacent dots are printed on successive scanning operations.

4. An inkjet recording apparatus operable in a first mode and a second mode, comprising:

a recording head having a plurality of inkjet recording elements for discharging ink dots on a recording medium in response to recording information;

first driving means for driving said recording head in a first direction to scan an elongated area along said first direction; and second driving means for advancing said recording medium in a second direction transverse to said first direction, said second driving means being controlled so that an operation of scanning is performed once for each elongated area in the first mode and is repeated a predetermined number of times for each elongated area in the second mode, the predetermined number of times being equal to or larger than four, said elongated area being divided into blocks each having a number of dots equal to the predetermined number and including dots arranged in two rows and two columns, wherein said inkjet recording elements are operated so that all of the dots in the elongated area are selected for printing on a single scanning operation in the first mode and so that a different one of the dots within each of the blocks in the elongated area are selected for printing upon successive scanning operations.

5. A recording method in an inkjet recording apparatus for printing in a first mode and a second mode by discharging ink droplets on a recording medium in response to recording information with a recording head having a plurality of inkjet recording elements, said recording head means being driven for scanning an elongated area in a first direction, said recording medium being advanced in a second direction transverse to said first direction, the method comprising the steps of:

driving, both in said first mode and said second mode, said recording head to scan an elongated area along said first direction;

advancing, in said first mode, said recording medium in a second direction transverse to said first direction so that an operation of scanning is performed once for each elongated area;

operating, in said first mode, said inkjet recording elements so that every dot in said elongated area is selected for printing during a single scanning operation;

advancing, in said second mode, said recording medium in the second direction transverse to said first direction so that the scanning operation is repeated by a predetermined number of times for the elongated area, the predetermined number being equal to or larger than four; and operating, in said second mode, said inkjet recording elements so that a different one of the dots within each of a plurality of blocks in the elongated area is selected for printing upon each scanning operation, the blocks each a number of dots equal to the predetermined number and including dots arranged in two rows and two columns.

* * * * *